United States Patent [19]

Keller

[11] 4,301,743

[45] Nov. 24, 1981

[54] PALLET

[75] Inventor: Lewis C. Keller, Andover, Mass.

[73] Assignee: Service Warehouse Company, Wilmington, Mass.

[21] Appl. No.: 44,776

[22] Filed: Jun. 1, 1979

[51] Int. Cl.[3] ..... B65D 19/26

[52] U.S. Cl. ..... 108/53.1

[58] Field of Search ..... 108/53.1, 53.3, 51.1, 108/57.1, 52.1, 91; 206/509, 511, 505, 510, 512, 503; 211/194; 217/43.8

[56] References Cited

U.S. PATENT DOCUMENTS

| | | | |
|---|---|---|---|
| 738,980 | 9/1903 | Bradley | 206/511 |
| 3,481,502 | 12/1969 | Slayman | 206/511 X |
| 3,526,195 | 9/1970 | Maryonovich | 108/53.1 |
| 3,561,375 | 2/1971 | Hammond et al. | 108/53.1 |
| 3,651,769 | 3/1972 | Foley | 108/52.1 |
| 3,720,176 | 3/1973 | Munroe | 108/53.1 X |
| 4,000,704 | 1/1977 | Griffin, Jr. | 108/53.1 |

FOREIGN PATENT DOCUMENTS

| | | | |
|---|---|---|---|
| 568923 | 4/1945 | United Kingdom | 108/51.3 |
| 1268752 | 3/1972 | United Kingdom | 108/55.3 |

*Primary Examiner*—William E. Lyddane

*Attorney, Agent, or Firm*—Wolf, Greenfield & Sacks

[57] ABSTRACT

A pallet for carrying and storing goods having lower and upper load bearing decks and separators disposed between and secured to the decks enabling a pallet jack or fork lift to be inserted between the panels. Locking means are provided in the decks so that when identical empty pallets are stacked one upon the other, they interlock so as to resist relative translational motion between the two. This feature also reduces the stack height of the pallets.

8 Claims, 9 Drawing Figures

PALLET

INTRODUCTION

This invention relates to pallets for carrying and storing goods and more particularly comprises a new and improved pallet having unique stacking features which resist relative translational motion of the pallets with respect to one another when stacked empty one on top of another.

One of industry's most essential tools is the pallet. Pallets are used in virtually every phase of industry to store and transport goods of all size and varieties. Developed out of necessity during World War II when the military services were required to move enormous quantities of supplies, the pallet now is as essential as any tool used in industry.

While the number of pallets in use has grown steadily since the 1940's and there now are literally millions of pallets in use, there has been very little change in pallet design since their inception. However, standard specifications for pallets have been adopted in certain industries. For example, the Grocery Pallet Council (GPC) has established rather precise specifications that have universally been accepted in connection with the distribution of foods, drugs and practically all consumer products. These standards inter alia, call for the use of hardwood in pallet construction, and that requirement alone has multiplied pallet costs over the past several years. It is estimated that between 70–80% of our forests are composed of softwood trees, hardwood is being exported in increased quantities, and domestic consumption of hardwood is also increasing. Approximately ten years ago a new hardwood pallet cost less than two dollars while today that price has increased to the eight dollar range. Even used pallets now cost in the range of five dollars. In spite of the rising cost, little has been done to modify their construction so as to increase pallet life.

Pallets are subjected to the greatest damage when in transit, stacked empty, one upon another in a trailer or other vehicle. The standard wood pallets available today do not have any means for interlocking them together when stacked empty, so as to prevent them from sliding off one another and tumbling about in the vehicle. Pallets are more frequently damaged when in transit empty than when in use to store or transport merchandise. The fact that the pallets are carrying merchandise requires that care be taken to protect the merchandise itself, and this in turn reduces wear on the pallets. On the other hand, when the pallets are empty, nothing is done to prevent them from sliding about and banging or digging into one another so as to crack or break the various boards from which they are constructed.

One important feature of the present invention is to provide pallets with an interlocking feature which will stablilize pallets when stacked one upon another.

Another important object of this invention is to provide an improved pallet compatible with standard wood pallets now in use.

Another object of the present invention is to provide a pallet with interlocking features, and which may be made for little or no more cost than so-called standard pallets widely used today.

Yet another object of this invention is to provide a pallet with interlocking features in its deck, which do not interfere in any way with the use of the pallets to store or transport goods nor in any way limit their load carrying capacity.

Another object of this invention is to reduce the stack height of empty pallets.

To accomplish these and other objects, the pallet of the present invention has upper and lower decks provided with locking means which are designed to engage the locking means in the decks of immediately adjacent-like pallets with which they are stacked.

In accordance with one embodiment of the invention, the decks are composed of boards that are selectively spaced so as to receive between them the boards of decks of other like pallets. In accordance with other embodiments of the invention, the deck is composed of boards that are specially shaped with ribs and grooves to interlock with the deck boards of immediately adjacent pallets.

BRIEF FIGURE DESCRIPTION

DETAILED DESCRIPTION

Figure 1:
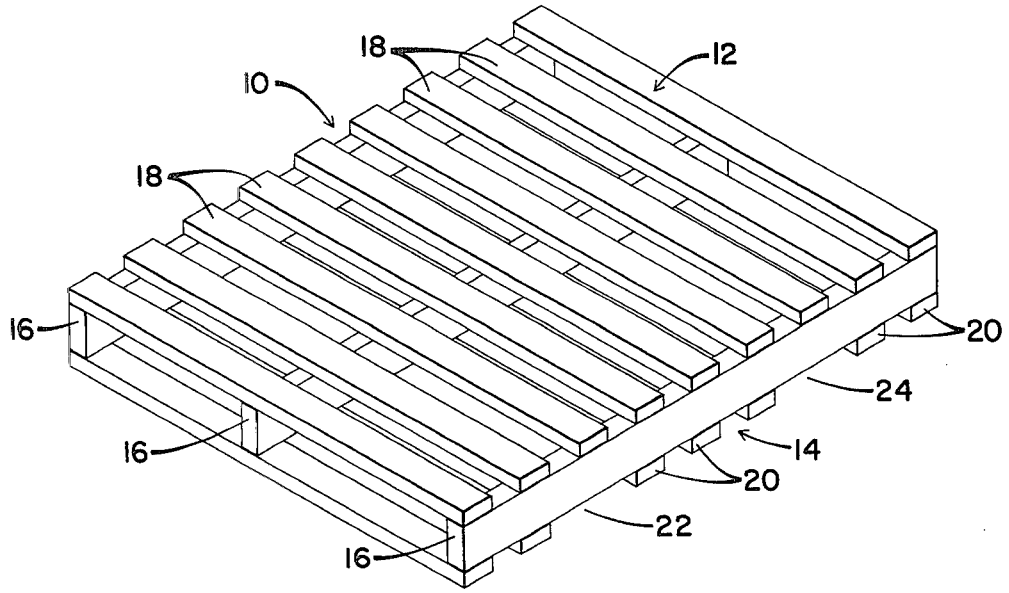
FIG. 1 is a perspective view of one embodiment of a pallet construed in accordance with my invention.
Figure 2:
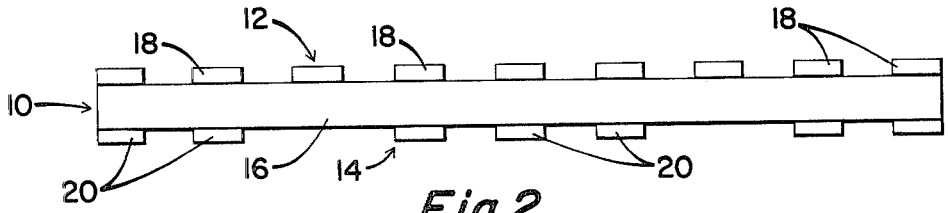
FIGS. 2 and 3 are side and end views thereof.
Figure 3:
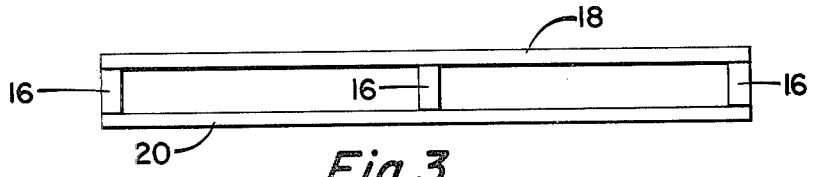

The pallet 10 shown in FIGS. 1–4 is of standard size, being approximately $48'' \times 40'' \times 5\frac{1}{2}''$, and includes upper and lower decks 12 and 14 respectively, and stringers 16 that separate the two decks. The pallet shown is not reversible, i.e., only its upper deck is intended to be used as the platform for carrying merchandise.

The upper deck 12 is composed of a plurality of boards 18. In accordance with this embodiment of the invention, the boards are all of approximately the same width and spaced apart a distance just exceeding the width of the individual boards. As shown, the boards 18 of the upper deck are all $2\frac{3}{4}''$ in width, and as nine such boards are used, the space between them may be just slightly less than 3". The boards may be $\frac{3}{4}''$ thick, and their length will of course equal the breadth of the pallet, i.e., ordinarily 40".

The lower deck 14 is also composed of a plurality of boards 20. They are, as shown, the same size as the boards in the upper deck. However, fewer boards are used. In accordance with this embodiment, seven boards 20 are shown, aligned beneath the boards 18 in top deck 12 except that lower boards are omitted beneath the third and seventh boards in the top deck, so as to provide slots 22 and 24 to receive a pallet jack. As the boards 20 are of the same size as boards 18 and are aligned with them, the spaces between the boards 20 are approximately 3" also.

The stringers 16 may typically be the dimensions specified by the GPC, namely $3\frac{3}{4}$" high and $1\frac{3}{4}$" wide. Their length of course is equal to the width of the pallet, and three such stringers are shown. The space between the decks defined by the stringers is provided to receive either a fork lift or pallet jack.

Figure 4:
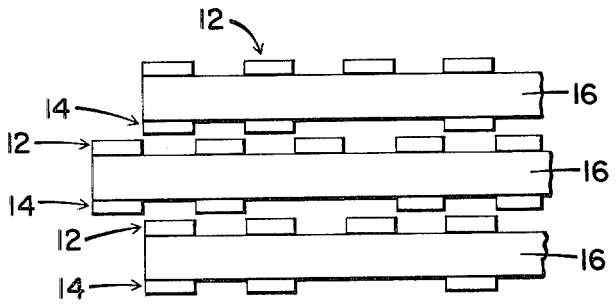
FIG. 4 is a fragmentary side view of several pallets identical to that shown in FIGS. 1–3, stacked in interlocking relationship with one another (but for purposes of clarity only, shown slightly separated).

FIG. 4 suggests the manner in which several pallets 10 may be piled one on top of the other and form a stable stack. Because the width of the spaces between the boards on both the bottom and top decks exceed the width of the boards themselves, the boards of one deck interleaf with the boards of the opposite deck of the next adjacent pallet on the top and bottom, and this arrangement prevents the pallets from slipping sideways with respect to one another. If the pallets are alternately staggered as shown, it will be appreciated that they will form a very stable column and remain stacked even when piled in the back of a truck and subjected to rapid acceleration and deacceleration of the vehicle. It will also be appreciated that the pallets may be stacked top to top and bottom to bottom as well as top to bottom because of the uniformity of the boards on both decks, and no attention need be paid as to whether they are all upright.

Figure 5:
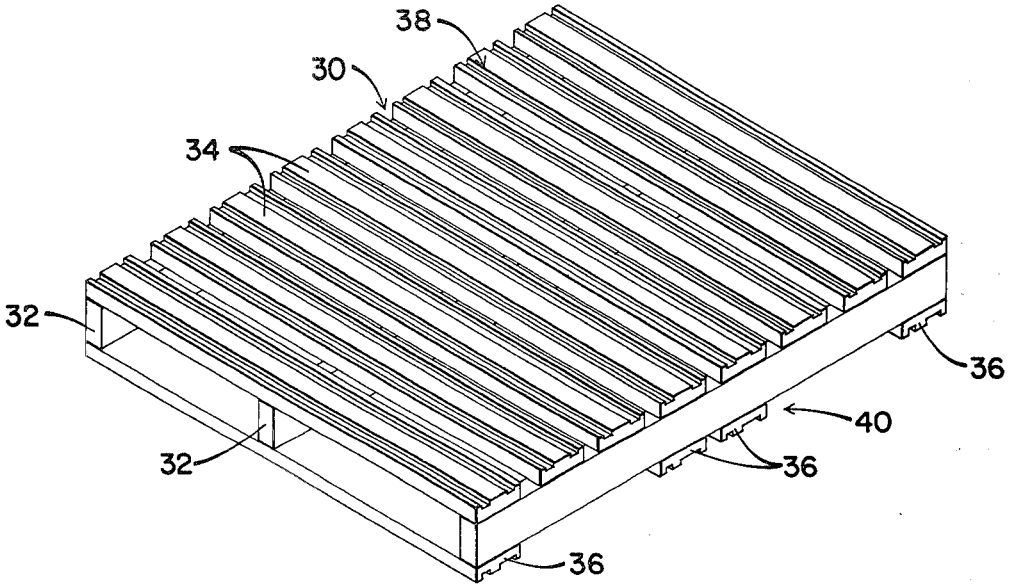
FIG. 5 is a perspective view of a second embodiment of pallet constructed in accordance with this invention.
Figure 8:
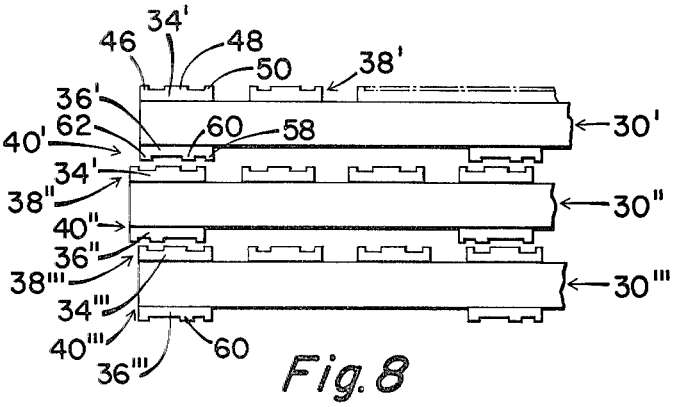
FIG. 8 is a side view of several pallets identical to that shown in FIG. 5, stacked in interlocking relationship with one another (but for purposes of clarity, also shown slightly separated).

The pallet 30 shown in FIGS. 5–8 is of the same overall dimensions as the pallet 10 of FIGS. 1–4. And its stringers 32 may be the same size as the stringers 16 of the first embodiment. However, the boards 34 and 36 in the upper and lower decks 38 and 40, respectively, are different from the boards 18 and 20, and in fact they are also different from one another. Each of the boards 34 in top deck 38 has a flat bottom surface 42 that bears against the upper edges 44 of the stringers 32. The upper surface is formed with three spaced ribs 46, 48 and 50 separated by a pair of grooves 52 and 54, all of which extend longitudinally the full lenth of the board. The ribs 46 and 50 in the embodiment illustrated are of the same width, as are grooves 52 and 54, but the center rib 48 is substantially wider than the other ribs. In the preferred form, the board is $4\frac{1}{2}$" wide, with ribs 46 and 50 being $\frac{1}{2}$" in width and rib 48 being $1\frac{1}{2}$" wide. The grooves are each 1" wide and $\frac{1}{4}$" deep. In FIGS. 5 and 8 the upper deck 38 is shown to include 8 such boards spaced apart slightly less than $1\frac{3}{4}$".

The boards 36 in the lower deck are of the same overall dimensions as the boards 34, namely $4\frac{1}{2}$"$\times\frac{3}{4}$"$\times$40". However, the ribs and grooves on the boards 36 are of different dimensions and orientation than in the boards 34. The upper surface 56 of each board 36 is flat just like the lower surface 42 of the top deck boards so that they will provide maximum contact with stringers 32. The lower surface of each board 36 has three ribs 58, 60 and 62 separated by two grooves 64 and 66. The ribs 58 and 62 are of the same width while the rib 60 is slightly wider and positioned off center with respect to the ribs 58 and 62 so that groove 64 is somewhat narrower than groove 66. In the specific embodiment illustrated, the ribs 58 and 62 are $\frac{1}{2}$" wide, rib $60\frac{3}{4}$" wide, and grooves 64 and 66 are $\frac{5}{8}$" and $2\frac{1}{8}$" wide, respectively and each is $\frac{1}{4}$" deep.

Figure 6:
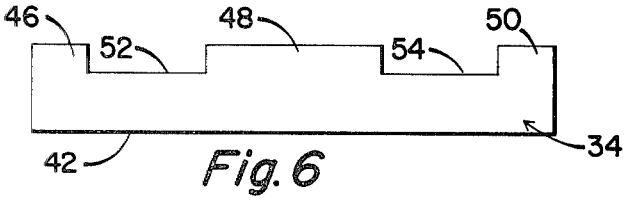
FIGS. 6 and 7 are end views of the top and bottom deck boards used in the embodiment of FIG. 5.
Figure 7:
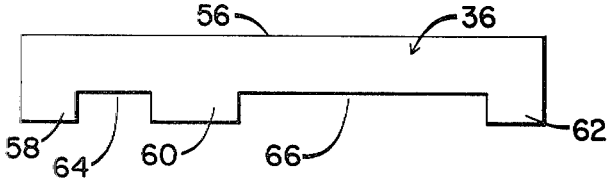

When the pallets 30, which like pallets 10 are nonreversible, are stacked one on top of the other as in FIG. 6, the ribs and grooves on the boards urge the pallets in a precise staggered orientation, and the pallets are designed to stack only top deck to bottom deck in a column. In FIG. 8, this particular stacking arrangement is suggested. The lower deck 40' of the topmost pallet 30' shown, registers with the upper deck 38" of the middle pallet 30" and similarly, the lower deck 40" of that pallet registers with the upper deck 38''' in the lowermost of the three pallets 30''' shown. It will also be noted that pallet 30" in the stack of FIG. 8 has been reversed 180° with respect to the pallet 30' and 30''' in order to achieve the alternately stepped or staggered arrangement as shown in FIG. 8. That is, while the bottom boards 36" in pallet 30" are oriented so that their middle ribs 60 are closer to the left side edge of each board as shown, in pallets 30' and 30''' the middle ribs 60 in the board 36' and 36''' respectively are closer to the right side edges of those boards. Consequently, when the pallets are stacked in the manner suggested, top pallet 30' is shifted to the left one step with respect to pallet 30" and rib 62 of board 36' in groove 52 of board 34", and rib 60 of board 36' lies in groove 54 of board 34". Described in another way, the wide rib 48 of board 34" in pallet 30" lies in groove 66 in the board 36' above, while rib 50 in board 34" lies in the smaller groove 64 in the board 36'. On the other hand, the registration of the ribs and grooves in the board 36" and 34''' are reversed. As a result, the staggered or stepped arrangement shown is achieved and assured. As a result, a leaning column cannot be built with the stack of pallets constructed as shown in FIG. 5 so long as they are alternately reversed.

Figure 9:
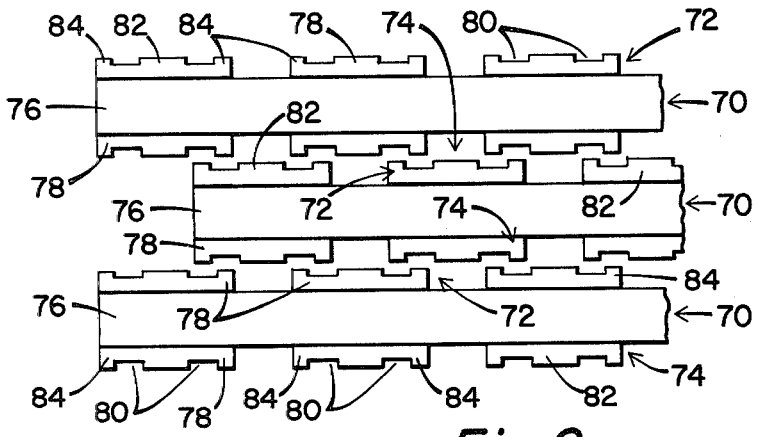
FIG. 9 is a side view of several identical pallets, constructed in accordance with yet a third embodiment of this invention, and showing how they may stack in interlocking relationship, but also shown slightly separated for clarity.

In the embodiment of FIG. 9, the boards that make up the upper and lower decks are grooved to interlock with one another, but the boards of the two decks are the same as is their spacing so that they may stack interlocked without regard to their orientation. Thus, in FIG. 9, each of the pallets 70 is shown to include upper and lower decks 72 and 74 separated by stringers 76, and the decks are made up of identical boards 78 spaced uniformly with respect to each other.

The individual boards 78 in this embodiment typically may be just like the boards 34 in the upper deck of the embodiment of FIGS. 5–8, and they may be spaced $1\frac{3}{4}$" apart. That is, the boards may be $4\frac{1}{2}$" wide, and $\frac{3}{4}$" thick, with the two grooves 80 being 1" wide each and defining a central rib 82 that is $1\frac{1}{2}$" wide and two end ribs 84 that are $\frac{1}{2}$" wide. If spaced apart $1\frac{3}{4}$" as suggested, it will be apparent that the pallets will readily interlock staggered back and forth without regard to top and bottom as well as side to side orientation.

The several embodiments shown are exemplary of a variety of different arrangements that may be used to achieve the interlocking arrangement between the stacked pallets so as to prevent them from sliding laterally with respect to one another when stacked with their deck boards running in the same direction. Because the pallets are not square, it is very easy and requires almost no attention for the person handling the pallets to stack them in that manner in the truck or other vehicle in which they are being transported.

In each of the embodiments shown, it will be appreciated that the upper and lower decks are free of any protrusions or extensions which could interfere with the stacking of merchandise on the pallets or which could mar or tear the merchandise or the cartons in which it is packed. The grooves formed in the surfaces of the boards in the embodiment of FIGS. 5 and 9 will no more interfere with the sliding of the merchandise on the pallets than do the spaces between boards in conventional pallets now in use. It will also be appreciated that the configuration of the boards both with respect to their positions on the stringers and their own cross sectional shapes does not in any way impose a limitation upon the materials from which the pallet is made. While the word "board" is used to describe the deck material, that word is not intended to serve as a limitation that the pallets be made of wood, but rather the members may be made of any otherwise acceptable materials possessing sufficient strength, rigidity and durability, such as aluminum, plastic, pressboard, etc. Moreover, the results may be achieved by making the decks of one piece rather than of several separate boards.

It should be appreciated that for certain types of material, such as products packaged in paper bags, the spacing of the boards as described in the embodiment of FIGS. 1–4 may not be acceptable, because the bags may distort or tear due to the spaces between the boards. In such a situation, either of the other embodiments shown may be more suitable. It of course also is possible to place a flat sheet of semi-rigid plastic or corrugated cardboard or other like material on the top deck to support the goods.

Having described this invention in detail, those skilled in the art will appreciate that numerous modifications may be made of the illustrated embodiments without departing from the spirit of this invention. Therefore, it is not intended that the breadth of this invention be limited to the two embodiments illustrated and described. Rather, the breadth of this invention is to be determined by the appended claims and their equivalents.

What is claimed is:

1. A pallet for carrying and storing goods comprising:

lower and upper load bearing decks and separators disposed between and secured to the decks enabling a fork lift or pallet jack to be inserted between the decks, and locking means formed in the lower and upper decks and confined to the planes of the decks for interlocking a pair of identical pallets together against relative translational motion when stacked in overlapping relationship, said upper and lower decks each being composed of a plurality of parallel boards, said locking means comprising ribs and grooves formed in said boards, each of the boards in the upper deck having in its top surface a plurality of ribs and grooves, and each of the boards in the lower deck having in its bottom surface a plurality of ribs and grooves, the boards of one of the decks having a pair of grooves of substantially the same width separated by a rib of greater width, and the boards of the other deck having a pair of ribs each adapted to fit into the grooves in the boards of the other deck of another pallet and having a relatively wide groove for receiving a rib on the boards of the other deck, the configuration of the ribs and grooves in the upper and lower deck boards causing the pallets to interlock in an alternately offset configuration when the pallets are alternately reversed 180° with respect to one another.

2. A pallet for carrying and storing goods as defined in claim 1 further characterized by the boards in both decks being identical.

3. A pallet for carrying and storing goods as described in claim 1 further characterized by the upper deck of one pallet being capable of interlocking only with the lower deck of an identical pallet.

4. A pallet for carrying and storing goods as described in claim 1 further characterized by the boards in the upper and lower decks having the same spacing between them in the respective decks.

5. A pallet array comprising:

at least two pallets each comprising, a first plurality of like thickness elongated boards disposed flatly and extending in parallel and forming an upper planar load bearing deck, a second plurality of like thickness elongated boards disposed flatly and extending in parallel and forming a lower planar load bearing deck, a plurality of stringers interconnecting the upper and lower decks so as to dispose the decks in parallel planes, said stringers being of like height, disposed transversely to said elongated boards and spaced relative to each other a greater distance than the spacing between boards of either deck, said upper and lower decks each having means defining ribs and grooves in the outer surface remote from the stringers, the ribs and grooves in the upper and lower deck boards causing the pallets to interlock when stacked in an alternately offset manner with a rib of one deck board and a rib of an adjacent deck board in the same deck interlocking with spaced respective grooves in the same deck board of a second pallet stacked thereon.

6. A pallet array as defined in claim 5 further characterized by the pallets being offset in a staggered manner with the offset being less than the width of a board.

7. A pallet array as defined in claim 5 further characterized by the boards of each deck each having three ribs defining two intermediate grooves.

8. A pallet array as defined in claim 7 further characterized by the boards of each deck being substantially the same size and shape.

* * * * *